United States Patent [19]

Brettschneider et al.

[11] Patent Number: 4,618,977

[45] Date of Patent: Oct. 21, 1986

[54] X-RAY TUBE COMPRISING AN AT LEAST PARTLY METAL HOUSING AND AN ELECTRODE WHICH CARRIES A POSITIVE HIGH VOLTAGE WITH RESPECT THERETO

[75] Inventors: Horst Brettschneider, Tangstedt; Walter Hartl; Diethard Peter, both of Hamburg, all of Fed. Rep. of Germany

[73] Assignee: U.S. Philips Corporation, New York, N.Y.

[21] Appl. No.: 806,132

[22] Filed: Dec. 9, 1985

Related U.S. Application Data

[63] Continuation of Ser. No. 436,121, Oct. 22, 1982.

[30] Foreign Application Priority Data

Oct. 24, 1981 [DE] Fed. Rep. of Germany ..... 3142281

[51] Int. Cl.[4] ..... H01J 35/16

[52] U.S. Cl. ..... 378/139; 378/121

[58] Field of Search ..... 378/139, 121

[56] References Cited

U.S. PATENT DOCUMENTS

| | | | |
|---|---|---|---|
| 1,975,880 | 10/1934 | Ulrey et al. | 378/121 |
| 3,517,195 | 6/1970 | Leavitt | 378/139 |
| 3,911,306 | 10/1975 | Peter | 378/139 |
| 4,053,802 | 10/1977 | Hartl | 378/121 |

*Primary Examiner*—Craig E. Church
*Assistant Examiner*—T. N. Grigsby
*Attorney, Agent, or Firm*—Robert J. Kraus

[57] ABSTRACT

In an X-ray tube comprising a metal housing portion and an electrode which can be connected to a positive high voltage with respect thereto and which is mounted on a ceramic insulator portion, a conical insulator portion is enclosed by a wall portion, at least the inner surface of which has an insulating effect. A screening sleeve which electrically screens the connection between the insulator portion and the electrode projects into a recess in the wall portion.

11 Claims, 4 Drawing Figures

X-RAY TUBE COMPRISING AN AT LEAST PARTLY METAL HOUSING AND AN ELECTRODE WHICH CARRIES A POSITIVE HIGH VOLTAGE WITH RESPECT THERETO

This is a continuation of application Ser. No. 436,121, filed Oct. 22, 1982.

BACKGROUND OF THE INVENTION

The invention relates to an X-ray tube which comprises an at least partly metal housing and an electrode which can be connected to a positive high voltage with respect thereto and which is mounted on a ceramic insulator, which projects into the tube, a connection area being surrounded by a screening sleeve which can be connected to the electrode potential.

An X-ray tube of this kind is known from GB 1,272,498; therein, the housing is made of metal and is connected to an anode via an insulator (in the form of a truncated cone.)

It is a drawback of the known X-ray tube that electrons can be emitted from the metal housing by field emmision; such electrons reach the anode along the insulator surface. After having travelled a given distance, such an electron has gathered enough energy to release other electrons which themselves release electrons again etc., so that across the insulator surface an electron avalanche occurs which causes substantial disturbances and development of gas in given circumstances or even a breakdown of the insulator.

This drawback is avoided in an X-ray tube disclosed in DE-OS 25 06 841, corresponding to U.S. Pat. No. 4,053,802. The anode and the metal housing thereof are interconnected by the way of an insulator which comprises a hollow space in the form of a truncated cone which becomes larger towards the cathode. In such an insulator configuration, an electron encounters an electric field across substantially the entire insulator surface which accelerates the electron directly from the insulator to the anode, that is to say via the vacuum space, so that discharges on the insulator surface are prevented to a high degree.

It is a drawback of this known X-ray tube, however, that due to the high relative dielectric constant of the ceramic insulator (approximately 10) the electric field is concentrated mainly in the space between the anode and the surface of the insulator which faces the anode. Consequently, at the area where the anode is connected to the ceramic insulator very high electric field strengths occur on the insulator surface which may cause breakdowns and other faults.

The same problem is encountered in rotary-anode X-ray tubes such as described in DE-PS 24 55 974, corresponding to U.S. Pat. No. 4,024,424 in which a shaft which supports the anode disk is rigidly connected to a ceramic insulator which itself is connected to a rotor.

SUMMARY OF THE INVENTION

It is the object of the invention to construct an X-ray tube of the kind set forth so that the occurrence of electron avalanches on the insulator surface is avoided to a high degree and that the field strength on the insulator surface is reduced. This object is achieved in accordance with the invention in that around the insulator there is provided a wall portion which has an insulating inner surface and which is connected to the metal housing portion, the screening sleeve projecting into the recess of the wall portion which faces the electrode without contacting the wall portion.

In accordance with the invention, the electric potential is reduced mainly on the insulator surface of the ceramic portion in the zone between the end of the screening sleeve and the connection to the wall portion, that is to say substantially uniformly. The distance d in the direction of the axis of the X-ray tube between the end of the screening sleeve and the connection area, therefore, may not be too small. It should satisfy the condition $d \leqq cU$, in which U is the maximum operating voltage and c is a constant having the value 0.1 mm/kV. In order to minimize the field strength load for the ceramic insulator portion, the screening sleeve (generally a cylindrical metal part) should electrically "cover" the connection of the electrode, or should extend across the insulator, only as far as is necessary for screening. The edge of the wall portion which faces the electrode carrying the high voltage should extend at least so far that the lower end of the screening sleeve which covers the connection area between the electrode and the insulator portion projects into the opening of the wall portion; it has been found in practice that 2 mm already suffices in this respect.

An electron arriving on the ceramic insulator portion will encounter an electric field in practically any location; this field would accelerate the electron across the insulator surface to the electrode, which could lead to tube faults according to DE-PS 25 06 841; however, this situation does not occur, because this part of the ceramic insulator is enclosed by the wall portion whose insulating inner surface substantially cannot emit electrons under the influence of field emission. Therefore, no metal conductor may be present on the inner surface of the wall portion.

The wall portion may be a separate insulator body which may consist of the same material as the insulator portion. The construction is particularly simple when the wall portion is formed by a metal ring, in the most attractive case the metal bulb of the X-ray tube itself, which is provided at this area with a layer which prevents field emission, for example, a glass layer or a coating of silicon spray. However, the wall portion and the insulator portion may also be formed by a single insulator body which comprises a concentric, annular recess. It is particularly advantageous when the inner portion which is enclosed by the recess and which supports the electrode connected to the high voltage, projects above the outer portion which encloses the recess, so that it can be more readily finished and the mounting of the electrode is simplified.

BRIEF DESCRIPTION OF THE DRAWINGS

The invention will be described in detail hereinafter with reference to the drawings.

DESCRIPTION OF THE PREFERRED EMBODIMENTS

Figure 1:
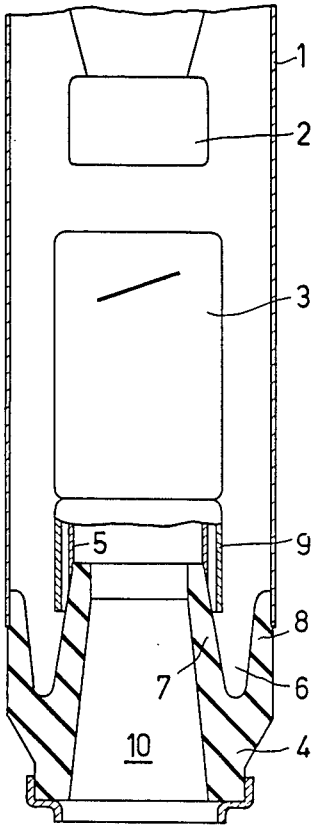
FIGS. 1 to 4 show different embodiments in accordance with the invention.

The reference numeral 1 in FIG. 1 denotes the metal tube bulb of an X-ray tube which comprises a fixed anode and whose cathode 2 is connected to the metal envelope 1 in a manner not shown. Via a fixing ring 5, the fixed anode 3 is connected to an insulator body 4 which itself is connected to the metal envelope 1. The rotationally symmetrical insulator body 4 comprises an annular recess, groove, trough 6 or similarly shaped indentation formed below an inner insulator portion 7 and by an outer wall portion 8 of the insulator body. The end surface of the inner insulator portion 7 which faces the anode 3 projects beyond the end face of the wall portion 8. This offers the advantage that the insulator portion can be easilly worked at this area and that the anode 3 can be simply mounted thereon by means of the ring 5.

A cylindrical screening sleeve 9 which is mechanically and electrically conductively connected to the anode 3 encloses the fixing ring 5 and projects outwards there beyond in the direction of the recess 6, so that the connection area between the ring 5 and the upper edge of the insulator portion 7 which is otherwise electrically effective with respect to the surroundings (the metal envelope 1) 1 is now screened to a high degree. It is important that the screening sleeve whose diameter is approximately 2 mm larger than the outer diameter of the ring 5 or the insulator portion 7 enters the opening of the wall portion 8 at this area, i.e. the lower edge of the screening sleeve 9 must be situated in a plane which intersects the wall portion 8. A penetration of approximately 2 mm already suffices in practice. The screening sleeve 9 may also penetrate the recess 6 further, but the distance d between the bottom of the recess 6 and the lower edge of the screening sleeve may not drop below the value $d=cU$, U being the maximum tube voltage and c being a constant whose value amounts to approximately 0.1 mm/kV.

An approximately uniform potential distribution arises on and in the insulator 7, so that it is ensured that the field strength in or on the insulator portion 7 does not reach inadmissible values. The highest field strength arises in the vacuum in the vicinity of the lower edge of the screening sleeve 9 which, however, does not adversely affect the behavior of the insulator device. When electrons reach the insulator portion 7, they encounter a field distribution on the insulator portion 7 which accelerates the electrons on the insulator surface towards the anode 3. Consequently, no faults arise during operation because the insulator portion 7 is enclosed by the wall portion 8 wherefrom substantially no electrons are emitted, so that the electron bombardment required for initiating discharges does not occur.

For the supply of the positive high voltage to the anode 3, the insulator body 4 is provided with a conical opening 10 which opens towards the outside and in which a high voltage connector can be inserted.

Figure 2:
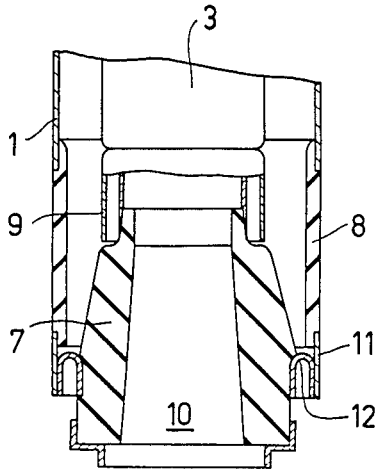

The insulator body 4 consists of a suitable ceramic material, preferably aluminium oxide. During the manufacture of such an insulator body, requiring heating up to 1500° C. and higher, however, thermal stresses can occur in unfavorable circumstances, so that the wall portion 8 may break off the insulator body 4. In order to prevent such breaking, it is necessary to take steps which render the manufacture of the insulator body more expensive. Therefore, FIG. 2 shows an embodiment in which the insulator portion 7 and the wall portion 8 are formed by separate insulators which may also be made of aluminium oxide ceramic. The wall Portion 8 is formed by a hollow cylinder and is secured to the metal envelope 1 in a suitable manner, for example, by soldering; on its lower end there is provided a ring 11 which itself is secured to the outer surface of an annular connection piece 12 having a U-shaped cross-section which opens in the downward direction and whose inner surface is connected to the insulator portion 7 so that a mechanically stable connection between the wall portion 8 and the insulator portion 7 is obtained. In comparison with the embodiment shown in FIG. 1, this embodiment offers the advantage that the manufacture of the separate insulator bodies 7 and 8 is less problematic; however, it is a drawback that additional fixing elements 11 and 12 have to be provided for interconnecting the wall portion 8 and the insulator portion 7.

Figure 3:
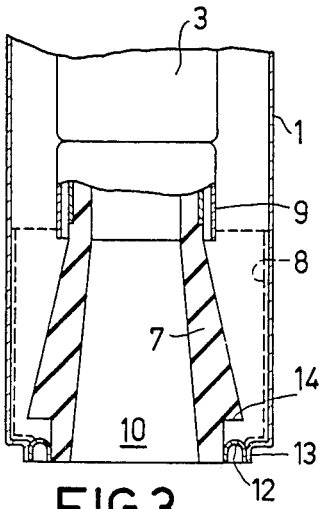

FIG. 3 shows a particularly simple embodiment. The wall portion 8 thereof comprises an annular metal portion which in this case forms part of the metal envelope 1 which is provided on its inner surface with a glass layer 8 as denoted by broken lines. The lower edge of the metal portion or the metal envelope comprises a collar-like constriction 13 which is connected to the insulator portion 7 via the annular connection piece 12. The insulator portion 7 also comprises a constriction at its lower area, so that the metal connection piece 12 is situated in a zone which is substantially field-free thanks to the projecting edge 14; consequently no electrons are released from the metal portion 12 by field emission.

Instead of the glass layer 8, use may alternatively be made of a layer obtained by spraying and burning of silicon. Other layers are also feasible. It is only important that this layer does not exhibit metallic conductivity but has only semiconductor or insulator properties and does not come loose from the metal portion during operation of the X-ray tube.

Figure 4:
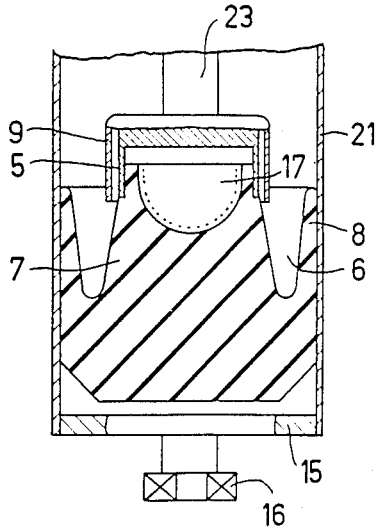

FIG. 4 shows an embodiment in which the metal portion 21 with respect to which the electrode carries a positive high voltage is not formed by the metal envelope of the X-ray tube but by the rotor of a rotary-anode X-ray tube or a portion which is connected thereto and which also rotates during operation of the rotary-anode X-ray tube. The electrode is formed by the anode disk or the shaft 23 which is mechanically and electrically conductively connected thereto and which is secured to the insulator portion 7 by means of the ring 5. The metal portion 21 is connected to a disk 15 which is rotatably journalled with respect to the metal envelope of the X-ray tube (not shown) by means of a bearing 16. It is to be noted that a rotary anode X-ray tube whose anode shaft is connected to a rotating insulator is known per se from DE 24 55 974. New is, however, the shape of the insulator body which corresponds to the shape of the insulator body shown in FIG. 1 in which no recess is provided for the high-voltage connector because the high voltage of the anode disk can be supplied via the other end of the shaft, as is known from said DE- 24 55 974.

In this solid embodiment it is advantageous to provide a central recess 17 at the upper end of the insulator portion 7, the inner surface of said recess being metallized and its bottom being situated at the area of the lower edge of the screening sleeve or therebelow. If this recess whose metallization carries the anode potential were absent, the equipotential lines would extend around the lower end of the screening sleeve 9 and from the fixing ring 5 to the upper end of the insulator portion 7, so that high field strengths would occur in the insulator in the vicinity of the lower end of the fixing ring 5. The recess 17 thus imposes a potential distribution in which the equipotential lines enclose only the lower part of the recess, so that the field strength in said critical zone is reduced.

What is claimed is:

1. An X-ray tube comprising an at least partly metal housing and an electrode which can be connected to a positive high voltage with respect thereto and which is mounted on a ceramic insulator projecting into the tube, a connection area between said electrode and said insulator being enclosed by a screening sleeve electrically connected to the electrode, wherein surrounding the insulator is provided a wall having an insulating inner surface and being connected to the metal housing, said screening sleeve projecting into a recess defined by the inner surface of the wall and an outer surface of the insulator, said recess having a bottom at a depth which is sufficient to ensure that the distance d between a bottom edge of the screening sleeve and the bottom of the recess is no smaller than $d=cU$, where c is a constant having an approximate value of 0.1 mm/kV and where U is the maximum voltage difference between the electrode and the housing.

2. An X-ray tube as claimed in claim 1, wherein said wall and said insulator form a coherent insulator body wherein is provided said recess.

3. An X-ray tube as claimed in claims 1 or 2 wherein said insulator portion which serves for the mounting of the electrode projects beyond the wall.

4. An X-ray tube as claimed in claim 1 or 2 wherein said insulator includes a central recess which opens towards the electrode and which is defined by a surface provided with a conductive layer electrically connected to the electrode.

5. An X-ray tube as claimed in claim 3, wherein said insulator includes a central recess which opens toward the electrode and which is defined by a surface provided with a conductive layer electrically connected to the electrode.

6. An X-ray tube comprising an at least partly metal housing and an electrode which can be connected to a positive high voltage with respect thereto and which is mounted on a ceramic insulator which projects into the tube, a connection area between said electrode and said insulator being enclosed by a screening sleeve electrically connected to the electrode, wherein around the insulator is provided a wall portion having an insulating inner surface and being connected to the metal housing, said screening sleeve projecting into a recess of the wall portion which faces the electrode, said sleeve not contacting the wall portion, and said insulator including a central recess opening toward the electrode, said recess being defined by a surface of the insulator provided with a conductive layer electrically connected to the electrode.

7. An X-ray tube comprising an at least partly metal housing and an electrode which can be connected to a positive high voltage with respect thereto and which is mounted on a ceramic insulator which projects into the tube, a connection area between said electrode and said insulator being enclosed by a screening sleeve which can be connected to the electrode potential, wherein around the insulator is provided a wall portion, said wall portion having an insulating inner surface and being connected to the metal housing portion, said screening sleeve projecting into a recess of the wall portion which faces the electrode, said sleeve not contacting the wall portion, said wall portion and said insulator form a coherent insulator body wherein is provided said cylindrical recess in the center of which is situated the insulator, said insulator being enclosed by the wall portion said wall portion with an insulating inner surface comprises a metal portion on an inner surface of which there is provided a layer which suppresses field emission.

8. An X-ray tube comprising an at least partly metal housing and an electrode which can be connected to a positive high voltage with respect thereto and which is mounted on a ceramic insulator which projects into the tube, a connection area between said electrode and said insulator being enclosed by a screening sleeve which can be connected to the electrode potential, wherein around the insulator is provided a wall portion, said wall portion having an insulating inner surface and being connected to the metal housing portion, said screening sleeve projecting into a recess of the wall portion which faces the electrode, said sleeve not contacting the wall portion, said wall portion and said insulator form a coherent insulator body wherein is provided said cylindrical recess in the center of which is situated the insulator, said insulator being enclosed by the wall portion, wherein said insulator and said wall portion each form an insulator body.

9. An X-ray tube as claimed in claim 7 or 8 wherein said insulator portion which serves for the mounting of the electrode projects beyond the wall portion.

10. An X-ray tube as in claim 9 where said insulator includes a central recess opening toward the electrode and which is defined by a surface of the insulator provided with a conductive layer electrically connected to the electrode.

11. A device as claimed in claim 3 wherein the metal portion forms the metal housing, and said insulator on its side which is remote from the electrode is provided with a recess for accommodating a high-voltage connector.

* * * * *